US006668923B2

(12) United States Patent
Vincent et al.

(10) Patent No.: US 6,668,923 B2
(45) Date of Patent: Dec. 30, 2003

(54) POSITIVE INDICATION SYSTEM FOR WELL ANNULUS CEMENT DISPLACEMENT

(75) Inventors: Ray P. Vincent, Cypress, TX (US); John Joseph Johnson, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/128,473

(22) Filed: Apr. 23, 2002

(65) Prior Publication Data

US 2002/0174985 A1 Nov. 28, 2002

Related U.S. Application Data

(60) Provisional application No. 60/286,100, filed on Apr. 24, 2001.

(51) Int. Cl.[7] ..... E21B 33/13; E21B 33/14; E21B 43/04

(52) U.S. Cl. ..... 166/253.1; 166/285; 166/250.14; 166/177.4

(58) Field of Search ..... 166/253.1, 250.14, 166/285, 177.4, 278, 290, 292, 51

(56) References Cited

U.S. PATENT DOCUMENTS

| | | | | | |
|---|---|---|---|---|---|
| 3,572,438 | A | | 3/1971 | Rohe | 166/285 |
| 3,865,188 | A | * | 2/1975 | Doggett et al. | 166/285 |
| 4,531,583 | A | * | 7/1985 | Revett | 166/277 |
| 4,602,684 | A | * | 7/1986 | Van Wormer et al. | 166/285 |
| 4,858,690 | A | | 8/1989 | Rebardi et al. | 166/278 |
| 5,024,273 | A | * | 6/1991 | Coone et al. | 166/285 |
| 5,373,899 | A | | 12/1994 | Dore et al. | 166/278 |
| 5,505,260 | A | * | 4/1996 | Andersen et al. | 166/278 |
| 5,531,273 | A | * | 7/1996 | Dobson et al. | 166/278 |
| 5,746,274 | A | * | 5/1998 | Voll et al. | 166/278 |
| 6,053,245 | A | | 4/2000 | Haberman | 166/250.14 |
| 6,125,935 | A | | 10/2000 | Shahin, Jr. | 166/250.14 |
| 6,557,634 | B2 | * | 5/2003 | Hailey et al. | 166/278 |

FOREIGN PATENT DOCUMENTS

| | | | | |
|---|---|---|---|---|
| RU | 2055160 C | | 2/1996 | |
| SU | 0591579 A | | 2/1978 | |
| SU | 1430501 A | | 10/1988 | |
| SU | 1661373 A | | 7/1991 | |
| WO | WO 8800275 A | * | 1/1988 | E21B/33/13 |

* cited by examiner

*Primary Examiner*—David Bagnell
*Assistant Examiner*—Brian Halford
(74) *Attorney, Agent, or Firm*—Madan, Mossman & Sriram, P.C.

(57) ABSTRACT

An annulus collar around a well production tube is cast in cement by a procedure that axially delineates the collar between two expandable well packers in the production tube string. Between the packers are a pair of cementing valves. An ingress valve is most proximate to the lower packer whereas an egress valve is most proximate to the upper packer. Additionally, the egress valve is modified to enclose the egress valve with a screen having mesh or slot openings that correspond with a screen plugging material that is mixed with the cement.

16 Claims, 5 Drawing Sheets

POSITIVE INDICATION SYSTEM FOR WELL ANNULUS CEMENT DISPLACEMENT

RELATED APPLICATION

This application is related to a U.S. provisional application titled "Positive Indication System for Well Annulus Cement Displacement" filed on Apr. 24, 2001, Ser. No. 60/286,100, and from which priority is claimed for the present application.

BACKGROUND OF THE INVENTION

1. Field of the Invention

The present invention relates to the tools and methods for earth boring and deep well completion. In particular, the invention relates to tools, materials and operational methods for placing an annulus of cement around a pipe or tube along a defined length of well bore.

2. Description of the Related Art

A well annulus is that generally annular space within a wellbore that may be between the raw borehole wall and the outside of a casing pipe suspended within the borehole. The term may also be applied to the annular space between the raw borehole wall and the outside surface of a fluid production tube. The well annulus may also be that annular space between the casing inside surface and the outer surfaces of a pipe or tube that is suspended within the casing.

Packers are well completion tools that are used to segregate axially adjacent sections of the well annulus to prevent the transfer of fluids, liquid or gas, from flowing along the length of an annulus from one section to another or migrating from one earth strata to another. More generally, the packer is a structural barrier across an annulus section that usually extends along a short length of the annulus.

Characteristically, inflatable packers comprise an elastomer or rubber sleeve element around the outer perimeter of a tubular mandrel. Opposite ends of the elastomer sleeve are secured to the mandrel. The tubular mandrel wall provides structural strength to physically link elements of a tubular work string above and below the packer. Additionally, the open bore along the mandrel center provides working fluid (hydraulic oil, etc.) flow continuity from surface located pumps to other tools below the packer.

The opposing ends of a packer sleeve may be overlaid by collar elements. One or both collars may include valve devices to admit pressurized fluid from the mandrel flow bore into the interface between the elastomer sleeve and the outer surface elements of the mandrel. Sufficient pressure within the interface expands the elastomer radially from the mandrel surface out to a tight, pressure seal against the internal walls of the annulus to prevent fluid flow in either direction along the annulus past the packer.

A wellbore zone to be produced through the flow bore of a production tube or casing liner is often isolated by an annular collar that is cast in cement around the production tube or casing liner. The cement collar is also cast in intimate contact with the surrounding borehole wall or inside surface of the casing bore. This collar seals the wellbore annulus around the casing liner and also secures the casing liner within the wellbore.

A prior art procedure for placement of the uncured collar cement within the well annulus includes placement of form packers in the well annulus above and below the collar segment. For downhole placement, the packers are tool segments of the well casing liner that are secured within the casing liner pipe string at positions of axial separation corresponding to the desired length of the cement collar. Between the packers, the casing liner (or production tube) may also include a pair of selectively opened and closed cement valve elements for providing respective cement flow paths between the flow bore of the casing liner and the surrounding annulus. By means of a cementing tool, a cement flow path between one of the cement valves and the tubular flow bore of the cement tool is isolated. Cement is pumped from the surface, along the cementing tool flow bore, through transverse flow ports in the cement tool, and into the annulus around the casing liner. The other cement valve in the casing liner string receives the material in the collar annulus that is displaced by the uncured cement. This displaced material is received into an inner annulus between the cementing tool and the interior of the casing liner.

A raw borehole profile often is irregular. Although the exact dimension of the outside casing liner dimensions are known, the unknown volume within the borehole prevents a precise determination of the annulus volume between the collar packers. Consequently, a considerable excess of cement is pumped into the collar annulus simply to assure that the collar annulus is filled. Any excess cement flows through the second cement valve into the inner annulus between the casing liner interior and the cementing tool exterior. Removal of the cementing tool swabs the casing liner bore of the excess cement.

A major difficulty of the foregoing prior art process is the unknown. Notwithstanding delivery of volumetrically excessive cement, there is no certainty that the collar annulus is completely filled. It is therefor, an objective of the present invention to provide equipment and procedures to positively conclude a volumetric filling of a collar annulus.

SUMMARY OF THE INVENTION

This and other objects of the invention as will become apparent from the following detailed description are obtained by a procedure that includes a shrouding screen over the cement return (ingress) valve. The cement egress valve is positioned along the casing liner or production string, as the case may be, between the pair of collar delineating packers but closely proximate of one. The screen shrouded return valve is also positioned between the packers but closely proximate of the other packer.

In cooperation with a liner casing or production tube having a shrouding screen over the cement ingress valve, the cement injected into the collar annulus is blended with a particulate or compatible thixotropic material that is matched to the mesh or slot opening of the shrouding screen.

Fluids within the collar annulus that are volumetrically displaced by a pressure driven influx of cement have a traditional drain route through the cement ingress valve and covering screen. However, when the particulate blended cement reaches the screen element over the cement ingress valve, the particulates will not pass through the screen openings. In due time, most of the screen mesh or slot opening will be bridged over by the cement borne particulates. A well working crew at the surface will recognize the condition by an increase in the cement pump discharge pressure as a consequence.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DESCRIPTION OF THE PREFERRED EMBODIMENTS

Figure 1:
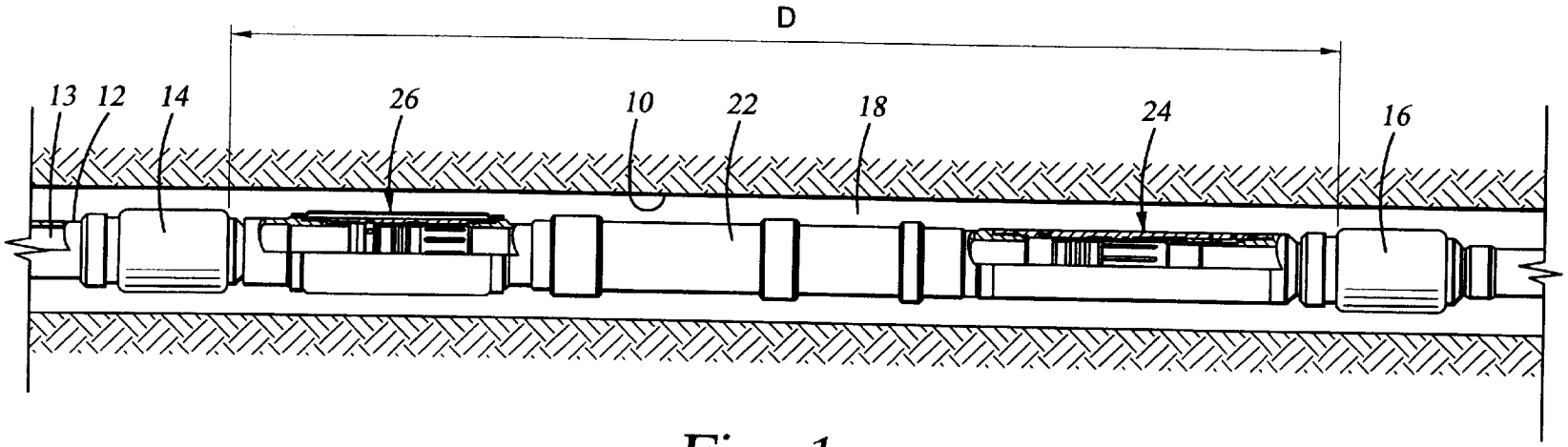
FIG. 1 is a partial section view of a well casing liner suspended within an uncased wellbore.
Figure 3:
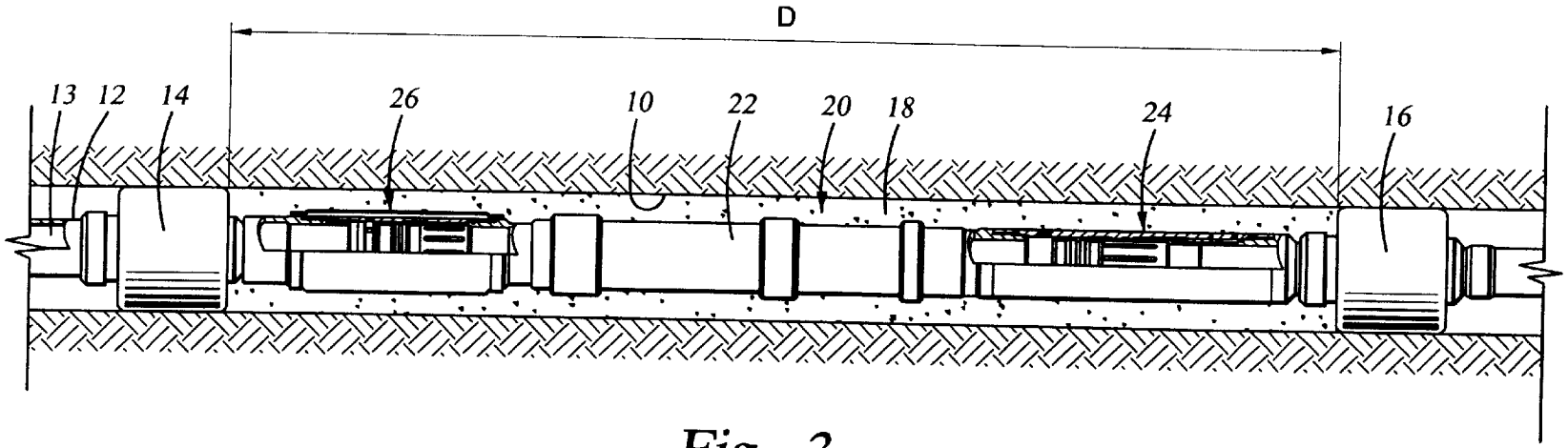
FIG. 3 is a partial section view of a well casing liner suspended within a cement collar.

A representative application of the invention is illustrated by FIG. 1 to include an open bore hole 10 having a casing liner 12 suspended therein. The casing liner may be a continuous pipe string that is supported at or near the surface, or, alternatively, may be concentrically sleeved within a larger diameter casing and suspended from an intermediate depth. An internal flow bore 13 of the casing liner is accessible at the surface as a conduit for well working fluids or as a mechanical guide channel for other tools and instruments suspended from the surface into and along the casing liner flow bore. Other applications of the invention may include, for example, a production tube within a cased and perforated bore hole.

The lower end of the casing liner may include an upper packer 14 and a lower packer 16. Although fluid inflatable packers are preferred, it should be understood that the term "packer" is merely a convenience reference to any form of selectively engaged annulus barrier that obstructs the continuity of the annulus 18. The packers 14 and 16 are separated by a distance D corresponding to the desired length of an annulus production collar 20 and linked by a casing liner subsection 22. The packers 14 and 16 are located, for example, along the length of the borehole 10 in relation to a particular well fluid production zone.

Within the casing liner subsection 22, and preferably adjacent to the lowermost packer 16, is an egress cementing valve 24 for channeling a discharge flow of uncured, fluidized cement from a cementing tool into the collar annulus 20. The material described herein as "cement" may also be or include other phase changing materials such as epoxies, polyesters, etc. An ingress cementing valve 26 for the return of fluid and other matter displaced by the cement occupation of the collar 20 annulus volume is preferably provided in the subsection 22 adjacent to the uppermost packer 14.

Although the preferred sequence and order of the cementing valves is to locate the egress valve 24 in the proximity of the lower packer 16 and to locate the ingress valve 26 in the proximity of the uppermost packer 14, those skilled in the art will understand and appreciate the fact that the sequence and order may be reversed.

Figure 4:
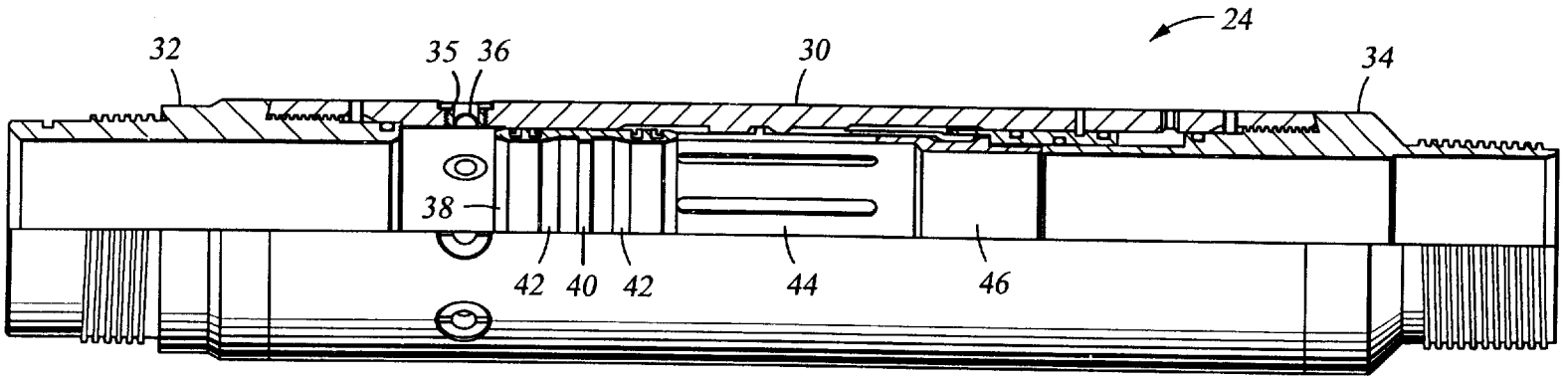
FIG. 4 is a partial section view of a single acting, egress cementing valve.
Figure 5:
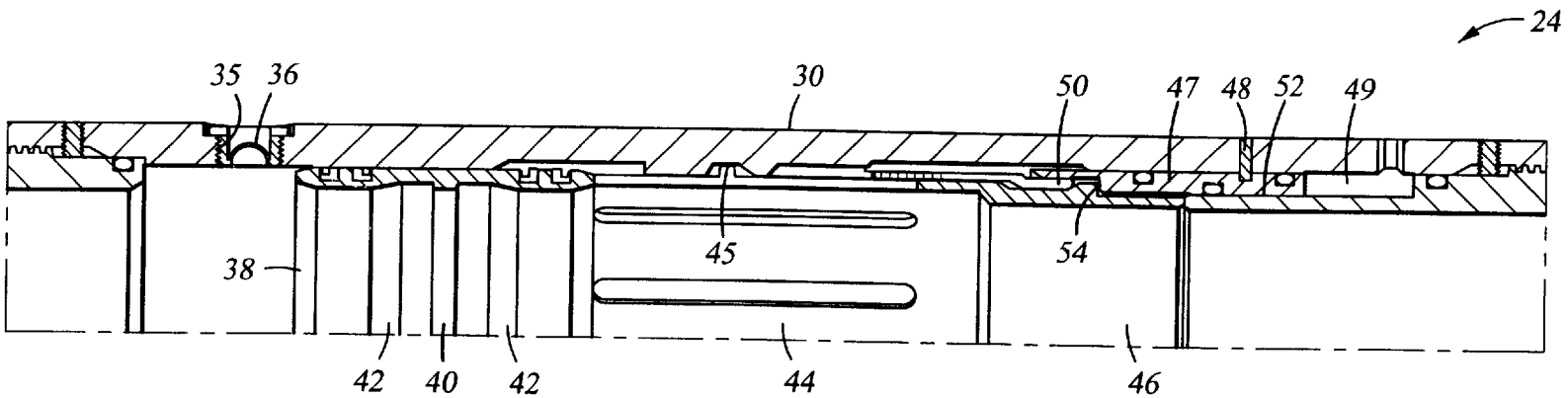
FIG. 5 is a detailed enlargement of the egress cementing valve illustrated by FIG. 4.

With respect to FIGS. 4 and 5, the egress cementing valve 24 comprises a tubular housing 30 subtended at opposite ends by threaded connecting subs 32 and 34. Near the upper connecting sub 32, the housing 30 is perforated by one or more orifices 35. The orifices are initially sealed by respective rupture discs 36. Internally of the housing 30, a closing sleeve 38 is provided with a close sliding fit against the inside wall surface of the tubular housing 30. The closing sleeve has a limited freedom of axial translation in opposite directions along the housing for opening and closing the orifice 35 to fluid flow after the rupture discs 36 are discharged and the orifice 35 opened. A circumferential rib 40 flanked by glide ramps 42 around the inside circumference of the closing sleeve provides an operational connection to a shifting tool 106 that will be described subsequently.

Integral with and positioned between the closing sleeve 38 and the guide sleeve 46 are a plurality of axially extended, resilient collet reeds 44. The outside perimeter of the collet reeds carries a latching shoulder 45.

A locking piston 47 displaced by internal bore pressure is secured against axial translation by a calibrated shear pin 48. A displacement space 49 is provided to receive the piston 47. A radially biased piston skirt 50 closes against the end surface 52 of the guide sleeve 46. However, the locking piston 47 will not secure the closed position of the closing sleeve 38 over the orifice 35 until the locking piston is translated into the displacement space 49. Such translation is selectively actuated by sufficient fluid pressure within the internal flow bore 13 bearing on the end of the locking piston to shear the pin 48. The actuation pressure is normally imposed by surface pumps not illustrated. The outer perimeter of the guide sleeve 46 carries a latching shoulder 54 that cooperates with the end of the biased skirt 50 to prevent reopening of the orifices 35 once the closing sleeve 38 has been translated to the closed position and the locking sleeve 47 has been translated into the displacement space 49.

Figure 6:
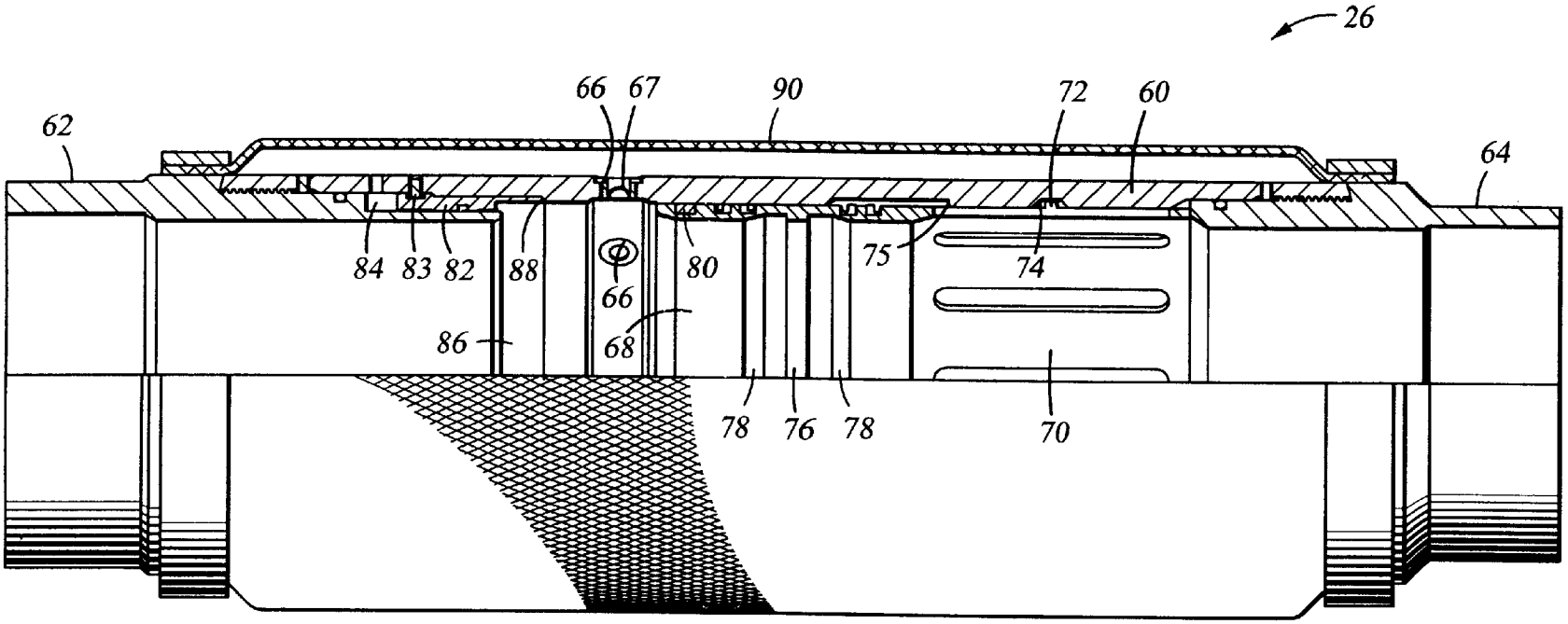
FIG. 6 is a partial section view of the double-acting ingress cementing valve.

The ingress cementing valve 26 is described by reference to FIG. 6 which illustrates an upper connecting sub 62 and a lower connecting sub 64. In threaded assembly between the two connecting subs is a tubular housing 60. The housing 60 is perforated by orifices 66. For downhole run-in, the orifices are closed by pressure rupture discs 67. Internally, the housing 60 confines a closing sleeve 68. The sleeve 68 is assembled to the internal bore of the housing 60 with a close sliding fit that overlies the orifices 66. Collet reeds 70 carry a detent ridge 72. The collet reeds resiliently bias the ridge into a circumferential detent channel 74 to releasably restrain the collet and closing sleeve at the open orifice position illustrated. The internal bore of the closing sleeve may include a circumferential tool rib 76 flanked by guide ramps 78. The outer perimeter of the closing sleeve includes a radially expansible lock ring 80.

Between the ingress valve upper sub 62 and the housing 60 is a lock piston 82 that is axially secured by a calibrated shear pin 83. Predetermined fluid pressure within the flow bore 13 applied to the inside cross-section of the bore shears the lock pins 83. Upon failure of the lock pins 83, the lock piston 82 shifts into the displacement space 84 and removes the piston skirt 86 from the housing counterbore shoulder 88. When the counterbore shoulder 88 is exposed and the closing sleeve 68 is shifted to the orifice 66 closure position, the lock ring 80 expands into the channel between the counterbore shoulder 88 and the end of the lock piston skirt 86. This meshing of the lock ring 80 against the counterbore shoulder 88 secures the sleeve 68 from subsequent opening.

Secured around the external perimeter of the housing 60 is a calibrated screen 90. The term screen is used herein to include all forms of sized flow paths which, for examples, may include meshed wire, parallel slots and drilled or punched orifices. Orifice or mesh opening dimensions or gage is highly dependent upon the material to be used with the collar forming cement. If the material blended with the cement is particulate, the orifices are sized to barely but confidently retain the particulate in a bridged position across the mesh or slot opening. An objective is to close the cement ingress path through the orifices 66 when the collar annulus is packed with cement. As a consequence of the operative cooperation between the screen mesh size and the cement blended particulate size, the collar annulus 20 must be filled with cement before all openings in the screen 90 are closed.

A specific example of the foregoing might include a 12 ga. meshed or slotted screen around the ingress orifices 66 to receive a collar annulus cement blended with resieved 20/40 U.S. Mesh Gravel. Appropriate particulates may include sand or ground glass. However, non-particulate cement additives may also be used to exploit flow properties such jelling or congealing under dynamic conditions.

Figure 7:
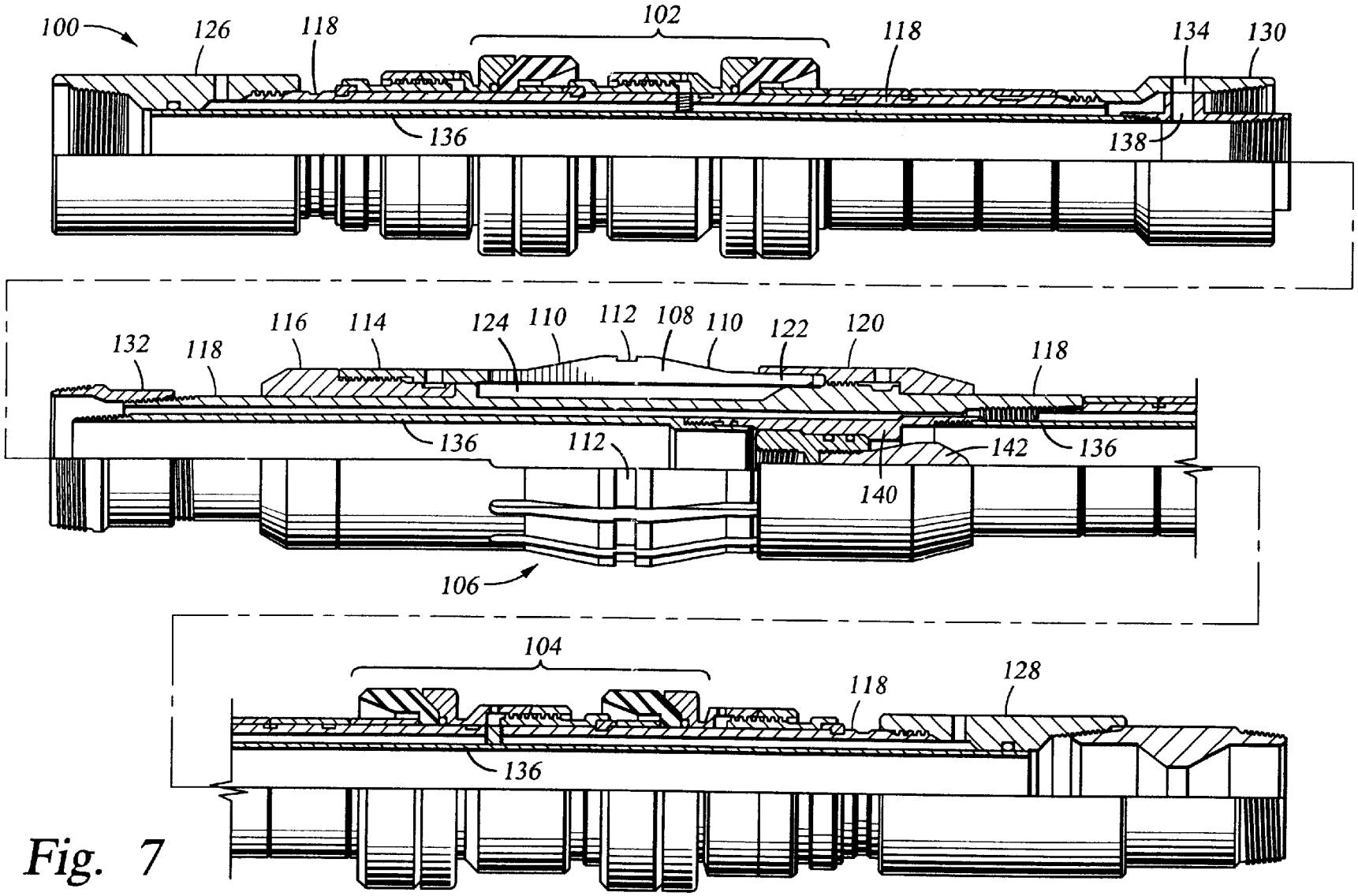
FIG. 7 is a partial section view of the cementing and shifting tool.

With respect to FIG. 7, the cementing tool 100 comprises a threaded assembly of three sectors including upper sealing elements 102 and lower sealing elements 104. Between the sealing elements is a shifting tool 106. The sealing elements may be substantially passive swab seals. The shifting tool 106 comprises a plurality of cylindrically distributed collet reeds 108 having symmetric ramp faces 110 flanking a tool ridge engagement slot 112.

The reed base sleeve 114 is secured to an upper collar 116 having a concentrically sliding fit about an outer mandrel 118. A lower collar 120 is threadably assembled with the outer mandrel but loosely overlies free tips 122 of the collet reeds 108. An annular, spring compliance space 124 spans beneath the collet reeds.

The outer mandrel 118 is a static, threaded assembly of tube between an upper collar 126 and a lower collar 128. The upper collar 126 assembles with the terminal end of a cement delivery conduit not illustrated. The cement delivery conduit extends to the wellbore surface and is connected at the surface to a pumped delivery system.

Between the upper and lower collars 126 and 128 is a cooperative box joint 130 and pin joint 132. The box joint is penetrated by an inner cement discharge orifice 134. An inner mandrel 136 extends from the upper collar 126 to the lower collar 128. An inner cement discharge orifice 138 aligns with the outer discharge orifice 134. Below the inner discharge orifice 138 is a bore plug seat 140 adapted to receive a surface launched bore sealing element 142 such as a ball, rod or dart.

Figure 2:
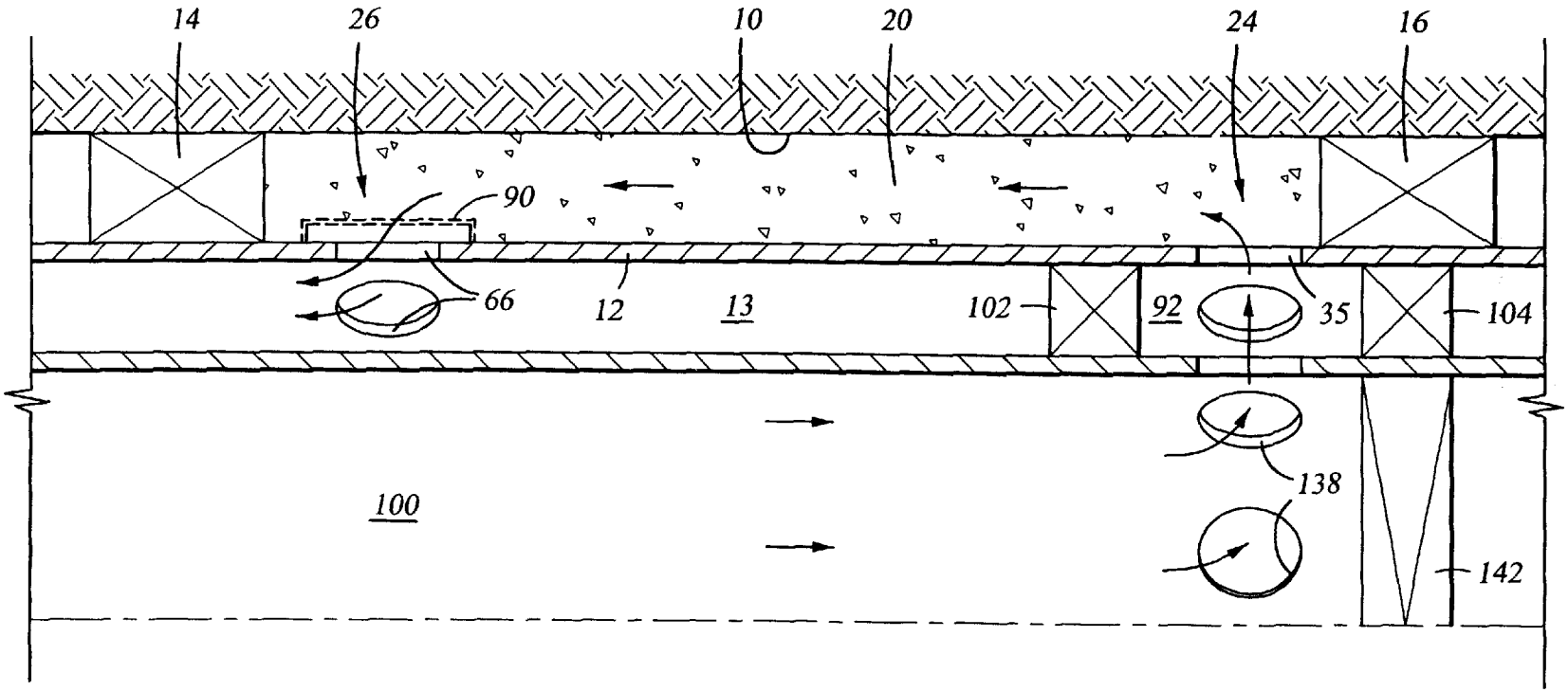
FIG. 2 is a line schematic of the invention in operation.

The invention method sequence is most conveniently understood from the schematic of FIG. 2 which illustrates a raw borehole wall 10 having a collar annulus 20 between a casing liner 12 and the borehole wall 10. The collar annulus extends along the borehole length between the upper packer 14 and the lower packer 16. Between the packers 14 and 16 is the egress cementing valve 24 and the ingress cementing valve 26. The flow orifice 66 of the ingress valve 26 is shielded by a calibrated mesh screen 90.

The cementing tool 100 is suspended within the internal bore of the casing liner 12 thereby providing an internal annulus 13. This internal annulus 13 is internal of the collar annulus 20. The cementing tool is positioned along the borehole length relative to the egress valve 35. The sealing elements 102 and 104 are located on opposite sides of the egress valve 35 and expanded to isolate the inner annulus section 92. This isolated inner annulus 92 provides a channel for the cement flow down the cementing tool flow bore from the orifices 138 to the orifices 35 of the egress valve 24. The annulus 92 between the cementing tool 100 and the casing liner 12 is isolated between the sealing elements 102 and 104. Consequently, the forced flow of cement is routed further through the egress valve 35 into the collar annulus 20.

When the tool 100 is positioned as required and the inner annulus sealing elements 102 and 104 are expanded, the dart 142 is deposited in the tool flow bore to seal the tube bore at the seat 140. Pump pressure within the flow bore may thereafter be increased to open the rapture disc in the egress valve 35.

The ingress valve rupture disc 67 may also be opened at this time and the collar annulus 20 proceed to receive cement.

As the collar annulus fills with cement from the egress valve 35, downhole formation fluids, drilling fluids and other debris is forced from the collar annulus 20 through the screen 90 and into the ingress orifice 66 until the cement reaches the screen 90. Fluids and other materials passing through the ingress orifice 66 are channeled uphole along the annulus 13 between the cementing tool 100 and the casing liner 12. As the aggregate laden cement attempts to penetrate the screen 90, the particulates correspondingly plug the protective mesh thereby effectively closing the ingress valve 26. The fact that the screen 90 enclosing the ingress valve 26 has plugged is objectively reported at the well surface by the discharge pressure in the cement displacement pump. The pump discharge pressure against the fluid column bearing on the cement abruptly rises. That fluid column is carried in the tubing bore of cementing tool 100.

With the cement collar 20 in place, the orifice 35 of egress valve 24 is closed by a translated shift of the sleeve 38. The cementing tool sealing elements 102 and 104 are retracted and the shifting tool 106 is manipulated to engage the shifting tool engagement slot 112 with the sleeve 38 rib 40. When engaged, the sleeve 38 is shifted to underlie the orifice 35 and thereby isolate it from the interior bore.

When the sleeve 38 shifts, the radially inward spring bias of the locking piston 47 skirt 50 contracts the locking piston radially to present an abuttment obstacle to the sleeve 38 latching shoulder 54 thereby caging the sleeve at the orifice closed position.

If desired, the orifice 55 may be reopened once by the shifting tool 106. Again the tool slots 112 engage the ribs 40 of the ingress valve sleeve 38. Force is applied on the tool 100 to shear the retaining pin 48 and displace the locking piston into the space 49.

After the ingress orifice 38 is closed, the shifting tool 106 is manipulated to engage the ingress valve 26 sleeve ridge 76. The closing sleeve 68 is shifted to underlie and close the orifice 66. The closing sleeve 68 is held at the open position by the collet reed detent ridge 72 resting in the housing detent channel 74. When shifting force is applied to the sleeve 68, the detent ridge 72 resiliently yields from the channel 74, but expands to abut the housing shoulder 75.

Shifting of the sleeve 68 to the orifice closure position also places the sleeve lock ring 80 contiguously within the piston skirt 86 of the lock piston 82. Opening and closing of the egress orifice 66 by reverse shifting of the sleeve 68 is optional until the lock piston 82 is shifted by fluid pressure within the internal flow bore 13. Sufficient flow bore pressure on the interior end of the lock piston 82 shears the retaining pin 84 to allow translation of the lock piston into the displacement space 84. Such translation extracts the piston skirt from around the resiliently biased lock ring 80 which consequently expands into the circumferential channel evacuated by the piston skirt 86.

Although the invention has been described in terms of specified embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A method of placing cement in an outer annulus around a first tube suspended within a well bore, said first tube having a first flow bore therein, said method comprising the steps of:

a. providing a pair of axially separated annulus barriers in an outer annulus around said first tube;

b. providing an ingress flow orifice in said first tube between said annulus barriers with greater proximity to a first annulus barrier;

c. providing an egress flow orifice in said first tube between said annulus barriers with greater proximity to a second annulus barrier;

d. enclosing said egress ingress flow orifice with a screen having fluid flow openings of a selected dimension;

e. suspending a cementing tool within said first flow bore, said cementing tool having a second flow bore and a cement flow orifice between said first and second flow bores, sealing elements bridging an inner annulus between said cementing tool and said first tube to isolate a flow channel from said second flow bore into said outer annulus;

f. blending an additive with cement, said additive having the capacity to plug the fluid flow openings in said screen; and g. pumping the blended cement along said second flow bore into said outer annulus until said fluid flow openings in said screen are substantially plugged.

2. A method of placing cement as described by claim 1 wherein the additive blended with cement is a particulate.

3. A method of placing cement as described by claim 2 wherein dimensions of said particulate are greater than the selected dimensions of said screen.

4. A well completion apparatus comprising:

a. a well casing having a pair of axially separated cementing valves between a first pair of external annulus barriers, one of said cementing valves having an ingress orifice for transferring a fluid flow from an exterior space around said casing into an interior flow bore; and b. a screen across said ingress orifice having selectively sized screen openings;

c. a fluid conduit tube within said casing flow bore having an interior flow bore, a second pair of exterior annulus barriers and a selectively applied flow bore obstruction.

5. A well completion apparatus as described by claim 4 wherein said cementing valves have sliding closure sleeves.

6. A well completion apparatus as described by claim 4 wherein said conduit tube includes a valve sleeve operating collet for engaging cementing valve closure sleeves.

7. A well completion apparatus as described by claim 4 wherein said cementing valves further comprise locking sleeves for selectively securing a final position of said closure sleeves.

8. A well completion apparatus comprising:

a. a well casing having axially separated ingress and egress cementing valves located between a first pair of external annulus barriers;

b. a screen across said ingress valve having selectively sized screen openings for interdicting particles mixed within a cementing fluid; and c. a sliding sleeve closure element for said egress valve, the sliding sleeve closure element being moveable between open and closed positions for selectively closing off flow of cement through said egress valve.

9. The well completion apparatus of claim 8 further comprising a rupture disk within the egress valve for providing an initial seal for said egress valve.

10. A The well completion apparatus of claim 8 further comprising a rupture disk within the ingress valve for providing an initial seal for said ingress valve.

11. The well completion apparatus of claim 8 further comprising a locking piston for securing the sliding sleeve closure element of the egress valve in a closed position.

12. The well completion apparatus of claim 8 wherein the screen is slotted.

13. The well completion apparatus of claim 8 wherein the screen is meshed.

14. The well completion apparatus of claim 8 wherein said well casing defines a casing flow bore and wherein the well completion apparatus further comprises a fluid conduit tube within said casing flow bore having an interior flow bore, a second pair of exterior annulus barriers and a selectively applied flow bore obstruction.

15. The well completion apparatus of claim 14 wherein said selectively applied flow bore obstruction comprises a surface-launched bore sealing element.

16. The well completion apparatus of claim 15 wherein said conduit tube includes a valve sleeve operating collet for engaging cementing valve sliding sleeve closure elements.

* * * * *

UNITED STATES PATENT AND TRADEMARK OFFICE

CERTIFICATE OF CORRECTION

PATENT NO. : 6,668,923 B2
DATED : December 30, 2003
INVENTOR(S) : Ray P. Vincent and John Joseph Johnson It is certified that error appears in the above-identified patent and that said Letters Patent is hereby corrected as shown below:

Column 7,
Line 20, please delete “egress” between “said” and “ingress”

Signed and Sealed this

Twenty-third Day of March, 2004

JON W. DUDAS
*Acting Director of the United States Patent and Trademark Office*